US011082784B2

(12) United States Patent
de Ruijter et al.

(10) Patent No.: US 11,082,784 B2
(45) Date of Patent: Aug. 3, 2021

(54) HEARING DEVICE INCLUDING A VIBRATION PREVENTING ARRANGEMENT

(71) Applicant: Sonion Nederland B.V., Hoofddorp (NL)

(72) Inventors: Laurens de Ruijter, Hoofddorp (NL); Nicolaas Maria Jozef Stoffels, Hoofddorp (NL); Theodorus Geradus Maria Brouwer, Hoofddorp (NL)

(73) Assignee: Sonion Nederland B.V., Hoofddorp (NL)

( * ) Notice: Subject to any disclaimer, the term of this patent is extended or adjusted under 35 U.S.C. 154(b) by 0 days.

(21) Appl. No.: 16/031,642

(22) Filed: Jul. 10, 2018

(65) Prior Publication Data

US 2019/0020958 A1 Jan. 17, 2019

(30) Foreign Application Priority Data

Jul. 13, 2017 (EP) ..... 17181173

(51) Int. Cl.

| | |
|---|---|
| ***H04R 25/00*** | (2006.01) |
| ***H04R 25/02*** | (2006.01) |
| *H04R 1/10* | (2006.01) |

(52) U.S. Cl.

CPC ..... *H04R 25/652* (2013.01); *H04R 25/02* (2013.01); *H04R 25/456* (2013.01); *H04R 25/48* (2013.01); *H04R 25/65* (2013.01); *H04R 1/1016* (2013.01); *H04R 2225/023* (2013.01); *H04R 2225/025* (2013.01)

(58) Field of Classification Search

CPC ..... H04R 25/48; H04R 25/02; H04R 25/456; H04R 25/604; H04R 25/65; H04R 25/652; H04R 2225/025; H04R 1/1016; H04R 1/1058; H04R 2201/107; H04R 2420/07

USPC ..... 381/312, 328, 380

See application file for complete search history.

(56) References Cited

U.S. PATENT DOCUMENTS

| | | | | |
|---|---|---|---|---|
| 3,048,668 A * | 8/1962 | Weiss | H04R 25/60 381/338 |
| 6,129,174 A * | 10/2000 | Brown | H04R 25/656 181/135 |
| 6,788,796 B1 | 9/2004 | Miles | |
| 6,831,577 B1 | 12/2004 | Furst | |
| 6,853,290 B2 | 2/2005 | Jorgensen | |
| 6,859,542 B2 | 2/2005 | Johannsen | |
| 6,888,408 B2 | 5/2005 | Furst | |

(Continued)

FOREIGN PATENT DOCUMENTS

| | | | |
|---|---|---|---|
| EP | 2624592 A1 | 8/2013 | |
| EP | 2753102 A1 * | 7/2014 | H04R 25/604 |

(Continued)

OTHER PUBLICATIONS

Extended European Search Report for Application No. EP 17181173.0, dated Jan. 19, 2018 (7 pages).

*Primary Examiner* — Ahmad F. Matar
*Assistant Examiner* — Sabrina Diaz
(74) *Attorney, Agent, or Firm* — Nixon Peabody LLP

(57) ABSTRACT

The present invention relates to a hearing device adapted to be positioned in an ear canal of a user, the hearing device comprising a receiver unit, a positioning member adapted to position and hold the hearing device in the ear canal of a user, and a vibration preventing arrangement adapted to prevent vibrations of a least part of the positioning member.

19 Claims, 8 Drawing Sheets

(56) References Cited

U.S. PATENT DOCUMENTS

| | | | | |
|---|---|---|---|---|
| 6,914,992 | B1 | 7/2005 | van Halteren | |
| 6,919,519 | B2 | 7/2005 | Ravnkilde | |
| 6,930,259 | B1 | 8/2005 | Jorgensen | |
| 6,943,308 | B2 | 9/2005 | Ravnkilde | |
| 6,974,921 | B2 | 12/2005 | Jorgensen | |
| 7,008,271 | B2 | 3/2006 | Jorgensen | |
| 7,012,200 | B2 | 3/2006 | Moller | |
| 7,062,058 | B2 | 6/2006 | Steeman | |
| 7,062,063 | B2 | 6/2006 | Hansen | |
| 7,072,482 | B2 | 7/2006 | Van Doorn | |
| 7,088,839 | B2 | 8/2006 | Geschiere | |
| 7,110,560 | B2 | 9/2006 | Stenberg | |
| 7,136,496 | B2 | 11/2006 | van Halteren | |
| 7,142,682 | B2 | 11/2006 | Mullenborn | |
| 7,181,035 | B2 | 2/2007 | van Halteren | |
| 7,190,803 | B2 | 3/2007 | van Halteren | |
| 7,206,428 | B2 | 4/2007 | Geschiere | |
| 7,221,767 | B2 | 5/2007 | Mullenborn | |
| 7,221,769 | B1 | 5/2007 | Jorgensen | |
| 7,227,968 | B2 | 6/2007 | van Halteren | |
| 7,239,714 | B2 | 7/2007 | de Blok | |
| 7,245,734 | B2 | 7/2007 | Niederdraenk | |
| 7,254,248 | B2 | 8/2007 | Johannsen | |
| 7,286,680 | B2 | 10/2007 | Steeman | |
| 7,292,700 | B1 | 11/2007 | Engbert | |
| 7,292,876 | B2 | 11/2007 | Bosh | |
| 7,336,794 | B2 | 2/2008 | Furst | |
| 7,376,240 | B2 | 5/2008 | Hansen | |
| 7,403,630 | B2 | 7/2008 | Jorgensen | |
| 7,415,121 | B2 | 8/2008 | Mögelin | |
| 7,425,196 | B2 | 9/2008 | Jorgensen | |
| 7,460,681 | B2 | 12/2008 | Geschiere | |
| 7,466,835 | B2 | 12/2008 | Stenberg | |
| 7,492,919 | B2 | 2/2009 | Engbert | |
| 7,548,626 | B2 | 6/2009 | Stenberg | |
| 7,657,048 | B2 | 2/2010 | van Halteren | |
| 7,684,575 | B2 | 3/2010 | van Halteren | |
| 7,706,561 | B2 | 4/2010 | Wilmink | |
| 7,715,583 | B2 | 5/2010 | Van Halteren | |
| 7,728,237 | B2 | 6/2010 | Pedersen | |
| 7,809,151 | B2 | 10/2010 | Van Halteren | |
| 7,822,218 | B2 | 10/2010 | Van Halteren | |
| 7,899,203 | B2 | 3/2011 | Van Halteren | |
| 7,912,240 | B2 | 3/2011 | Madaffari | |
| 7,946,890 | B1 | 5/2011 | Bondo | |
| 7,953,241 | B2 | 5/2011 | Jorgensen | |
| 7,961,899 | B2 | 6/2011 | Van Halteren | |
| 7,970,161 | B2 | 6/2011 | van Halteren | |
| 8,098,854 | B2 | 1/2012 | van Halteren | |
| 8,101,876 | B2 | 1/2012 | Andreasen | |
| 8,103,039 | B2 | 1/2012 | van Halteren | |
| 8,160,290 | B2 | 4/2012 | Jorgensen | |
| 8,170,249 | B2 | 5/2012 | Halteren | |
| 8,189,804 | B2 | 5/2012 | Hruza | |
| 8,189,820 | B2 | 5/2012 | Wang | |
| 8,223,996 | B2 | 7/2012 | Beekman | |
| 8,233,652 | B2 | 7/2012 | Jorgensen | |
| 8,259,963 | B2 | 9/2012 | Stenberg | |
| 8,259,976 | B2 | 9/2012 | van Halteren | |
| 8,259,977 | B2 | 9/2012 | Jorgensen | |
| 8,280,082 | B2 | 10/2012 | van Halteren | |
| 8,284,966 | B2 | 10/2012 | Wilk | |
| 8,313,336 | B2 | 11/2012 | Bondo | |
| 8,315,422 | B2 | 11/2012 | van Halteren | |
| 8,331,595 | B2 | 12/2012 | van Halteren | |
| 8,369,552 | B2 | 2/2013 | Engbert | |
| 8,379,899 | B2 | 2/2013 | van Halteren | |
| 8,509,468 | B2 | 8/2013 | van Halteren | |
| 8,526,651 | B2 | 9/2013 | Lafort | |
| 8,526,652 | B2 | 9/2013 | Ambrose | |
| 2007/0036379 | A1* | 2/2007 | Anderson | H04R 25/656 381/324 |
| 2007/0071265 | A1* | 3/2007 | Leedom | H04R 25/652 381/322 |
| 2010/0061580 | A1* | 3/2010 | Tiscareno | H04R 1/1016 381/380 |
| 2011/0182453 | A1 | 7/2011 | van Hal | |
| 2011/0189880 | A1 | 8/2011 | Bondo | |
| 2011/0299708 | A1 | 12/2011 | Bondo | |
| 2011/0299712 | A1 | 12/2011 | Bondo | |
| 2011/0311069 | A1 | 12/2011 | Ambrose | |
| 2012/0014548 | A1 | 1/2012 | van Halteren | |
| 2012/0027245 | A1 | 2/2012 | van Halteren | |
| 2012/0140966 | A1 | 6/2012 | Mocking | |
| 2012/0155683 | A1 | 6/2012 | van Halteren | |
| 2012/0155694 | A1 | 6/2012 | Reeuwijk | |
| 2012/0255805 | A1 | 10/2012 | van Halteren | |
| 2013/0028451 | A1 | 1/2013 | de Roo | |
| 2013/0136284 | A1 | 5/2013 | van Hal | |
| 2013/0142370 | A1 | 6/2013 | Engbert | |
| 2013/0163799 | A1 | 6/2013 | van Halteren | |
| 2013/0195295 | A1 | 8/2013 | van Halteren | |
| 2013/0279732 | A1 | 10/2013 | Sanecki | |
| 2014/0355809 | A1* | 12/2014 | Killion | H04R 1/1016 381/380 |
| 2016/0192058 | A1* | 6/2016 | Kelly | H04R 1/1066 381/87 |
| 2018/0020302 | A1* | 1/2018 | Rasmussen | H04R 25/60 |

FOREIGN PATENT DOCUMENTS

| | | | |
|---|---|---|---|
| EP | 2753102 | A1 | 7/2014 |
| WO | WO 00/69216 | A2 | 11/2000 |
| WO | WO 00/69216 | A3 | 11/2000 |

* cited by examiner a)

b)

a)

b)

HEARING DEVICE INCLUDING A VIBRATION PREVENTING ARRANGEMENT

CROSS-REFERENCE TO RELATED APPLICATIONS

This application claims the benefit of European Patent Application Serial No. 17181173.0, filed Jul. 13, 2017, which is incorporated herein by reference in its entirety.

FIELD OF THE INVENTION

The present invention relates to a hearing device comprising a vibration preventing arrangement in order to allow a higher stable gain between a microphone inlet and a receiver output. The hearing device is adapted to be positioned within the ear canal of a user.

BACKGROUND OF THE INVENTION

Receiver in the canal (MC) and Microphone and Receiver in the canal (MRIC) are known design approaches within the hearing aid community. A MC may be implemented as a hearing device where the microphone is positioned behind the ear, whereas an MRIC has the microphone positioned in the ear canal. RICs and MRICs may be implemented with either a closed dome or an open dome.

As in particular the MRIC is a very compact device the achievable stable gain is limited by the feedback signal, i.e. the amount of signal being picked up by the microphone (generated by the MRIC itself), divided by the sound pressure in the ear canal. Thus, the higher the feedback, the lower the stable gain between microphone input and receiver output.

Thus, there seems to be a need for providing an arrangement that allows a higher stable gain in for example RICs and MRICs.

It may be seen as an object of embodiments of the present invention to provide an appropriate arrangement for reducing feedback within a hearing device.

It may be seen as a further object of embodiments of the present invention to provide an appropriate arrangement that allows a higher stable gain between a microphone inlet and a receiver outlet of a hearing device, such as an MMC.

SUMMARY OF INVENTION

The above-mentioned objects are complied with by providing, in a first aspect, a hearing device adapted to be positioned in an ear canal of a user, the hearing device comprising, a receiver unit, a positioning member adapted to position and hold the hearing device in the ear canal of a user, and a vibration preventing arrangement adapted to prevent vibrations of a least part of the positioning member.

Thus, the first aspect of the present invention relates to the hearing device adapted to the inserted in the ear canal of the used. The hearing device may be of the type microphone and receiver in the canal (MRIC).

The term "positioning member" is to be understood as any member being capable of positioning and holding the hearing device in a correct position within the ear canal of the user. A correct position of the hearing device may be a position where the acoustical performance of the hearing device is optimized. In addition, the "positioning member" may ensure that the hearing device may be carried with great comfort over long periods of time.

The term "vibration preventing arrangement" is to be understood as any arrangement being capable preventing that receiver generated vibrations are transferred to the positioning member. Thus, the "vibration preventing arrangement" prevents that at least part of the positioning member vibrates whereby feedback signals to a microphone unit may be avoided. As disclosed in details below the "vibration preventing arrangement" may be implemented as a vibration isolation arrangement or an arrangement that provides stiffness to at least part of the positioning member.

The receiver unit may be adapted to operate in an audible range, such as in the range 0-20 kHz, such as in the range 10 Hz-18 kHz.

The effect of the vibration preventing arrangement may generally result in a vibration reduction gain within the range 5-20 dB, such as within the range 10-15 dB, within the frequency range 100 Hz-8 kHz.

In general, the hearing device may further comprise one or more additional transducers, such as one or more additional receiver units and/or one or more additional microphone units, said one or more additional transducers being integrated with and/or associated with the hearing device. In case of being integrated with the hearing device the one or more additional transducers may be positioned within the same hearing device housing as the receiver unit. In case of being associated with the hearing device the one or more transducers may be positioned outside a hearing device housing comprising the receiver unit. It should be noted that other types of transducers/sensors may be included as well.

The hearing device may in particular comprise a microphone unit being either integrated with the hearing device or being associated therewith. In case of being integrated with the hearing device the microphone unit may be positioned within the same hearing device housing as the receiver unit. In case of being associated with the hearing device the microphone unit may be positioned outside a hearing device housing comprising the receiver unit.

In a first embodiment the vibration preventing arrangement may comprise a vibration isolation arrangement adapted to vibration isolate at least part of the positioning member from the receiver unit. Thus, the vibration isolation arrangement may be arranged at a position between the receiver unit and a part of the positioning member that is not allowed to vibrate in response to receiver generated vibrations. The vibration isolation arrangement may form a suspension member between the receiver unit and at least part of the positioning member. In order to provide appropriate vibration isolation properties the suspension member may be more compliant than the positioning member. The higher compliance of the suspension member may be achieved by using a softer material or by shaping, such as thinning, the material defining the suspension member. The vibration isolation arrangement and the positioning member may form a single and integral member of the same material, such as rubber or silicone. Moreover, a stem forming an integral part of the single integral member may be provided. The stem may be adapted to be secured to a spout/nozzle of the hearing device or the receiver unit. In terms of manufacturing the vibration isolation arrangement and the positioning member may be manufacturing using a suitable injection moulding technique As an alternative to the above-mentioned integral solution the vibration preventing arrangement may comprise a discrete member adapted to vibration isolate at least part of the positioning member from the receiver unit. Similar to the integrated solution the discrete member may be more compliant than the positioning member. This may be achieved by manufacturing the discrete member in a soft material, such as rubber or silicone.

Similar to the integrated solution a stem adapted to be secured to a spout/nozzle of the hearing device or the receiver unit may be provided. In this implementation the discrete member may be secured to the positioning member and the stem via respective engaging members and recesses. The positioning member may be made of a first material, the stem may be made of a second material, whereas the discrete member may be made of a third material. The first and second materials may be the same material, whereas the third material may be a softer material. The first, second and/or third materials may all be rubber or silicone materials although the third material may be a softer compound that the first and second materials.

In a second embodiment the vibration preventing arrangement may comprise thickness variations, such as angular and/or radial thickness variations, of at least part of the positioning member in order to make selected portions of the positioning member stiffer. Thus, according to this embodiment selected portions of the positioning member is/are made stiffer via thickness variations whereby the overall system comprising the MRIC and the positioning member becomes less sensitive to receiver generated vibrations.

In case of angular thickness variations the vibration preventing arrangement may comprise a number of essentially concentrically arranged rings secured to or integrated with the positioning member. In case of radial thickness variations the vibration preventing arrangement may comprise a number of radially arranged ribs secured to or integrated with the positioning member. Moreover, a number of spirals secured to or integrated with the positioning member may be provided in order to provide desired thickness variations. The number of rings, spirals and/or ribs as well as the position thereof may be tailored to meet certain demands. The number of rings, spirals and/or ribs may vary from 1 to 15, or even more, and the rings and/or ribs may be evenly or unevenly distributed on a concave or a convex surface of the positioning member. Moreover, the cross-sectional profiles of the rings, spirals and/or ribs may be identical or different.

The second embodiment may further comprise a stem adapted to be secured to a spout/nozzle of the hearing device or a receiver unit of the hearing device. The positioning member, the vibration preventing arrangement in the form of thickness variations and the stem may form a single and integral member of the same material, such as rubber or silicon.

In general, at least part of the positioning member may take the form of a dome-shaped element, i.e. a dome umbrella.

In a second aspect the present invention relates to a hearing device adapted to be positioned in an ear canal of a user, the hearing device comprising, a receiver unit, and an positioning member adapted to position and hold the hearing device in the ear canal of a user, wherein the receiver unit is moveably arranged relative to the positioning member so that receiver unit induced vibrations are essentially not transferred to the positioning member.

Thus, according to the second aspect the receiver unit may be allowed to move or slide relative to the positioning member and/or a stem secured to or integrated with the positioning member whereby receiver generated vibrations are not transferred to the positioning member.

In order to control the relative movements between the receiver unit and a stem a number of inwardly directed projections integrated therewith and/or attached to the stem may be provided. A number of mechanical stop members may limit the movements of the projections, and thereby the stem, relative to a spout/nozzle secured to the receiver unit. In this manner the relative movements between the spout/nozzle and the stem may be fully controlled.

The positioning member of the first and second aspects may comprise a tuned venting opening. The tuned venting opening may be in the form of a through-going opening in the positioning member. A tuned venting opening is advantageous in that it may be used to offer customers non-occluded hearing devices, such as RICs and/or MRICs, while the vibration preventing arrangement reduces the sound production of the positioning member in the frequency range where the dome is blocking/damping the sound coming from inside the ear canal.

It may be desirable to reduce the movable area of the positioning member in that this will also reduce the vibrations of the positioning member and thereby a potential feedback to a microphone. The moveable area of the positioning member of the first and second aspects may be reduced using an arrangement, such as a substantially stiff rim secured to a housing of the hearing device. The substantially stiff rim may either be inserted between the positioning member and the housing of the hearing device, or it may mechanically support a portion of the positioning member, such as the portion being closest to the housing of the hearing device. Both implementations will effectively reduce the moveable area of the positioning member and thereby a potential feedback to a microphone of the hearing device.

BRIEF DESCRIPTION OF THE DRAWINGS

The present invention will now be described in further details with reference to the accompanying figures, wherein.

Figure 1:
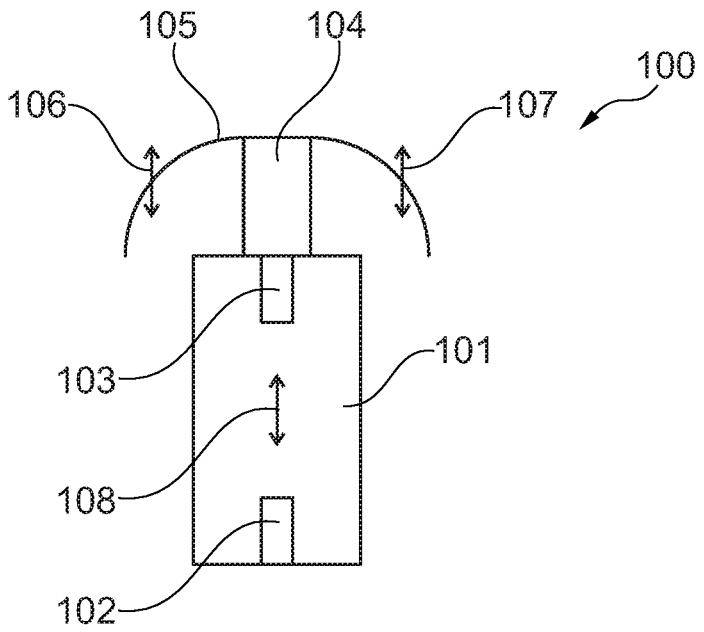
Fig. 1 Prior art
FIG. 1 shows a prior art implementation.
Figure 2:
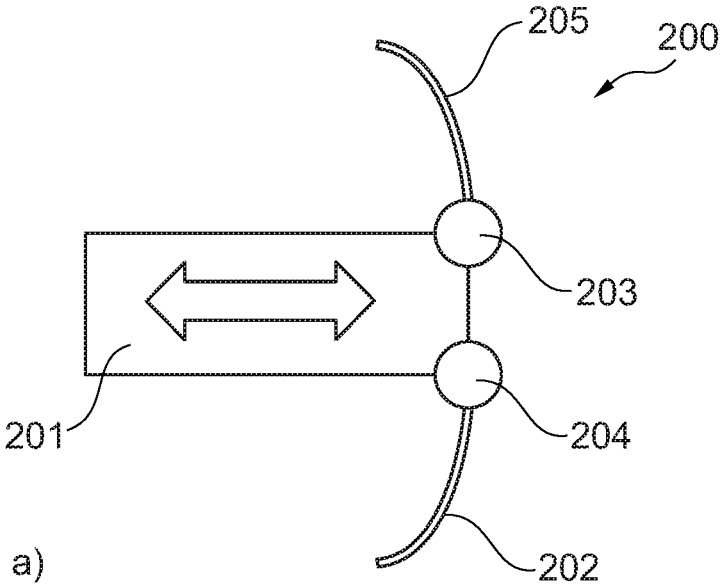
FIG. 2 shows cross-sectional views of vibration isolation arrangements inserted between a hearing device and a dome umbrella.
Figure 2:
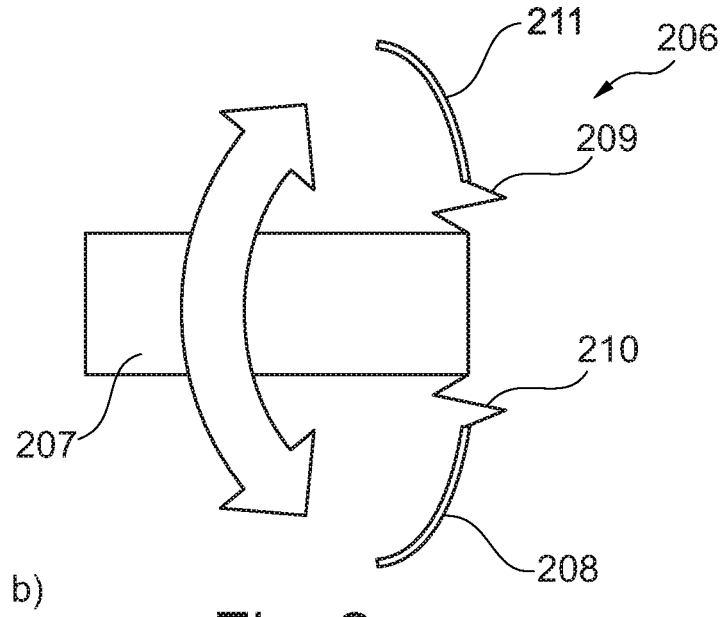
Figure 2:
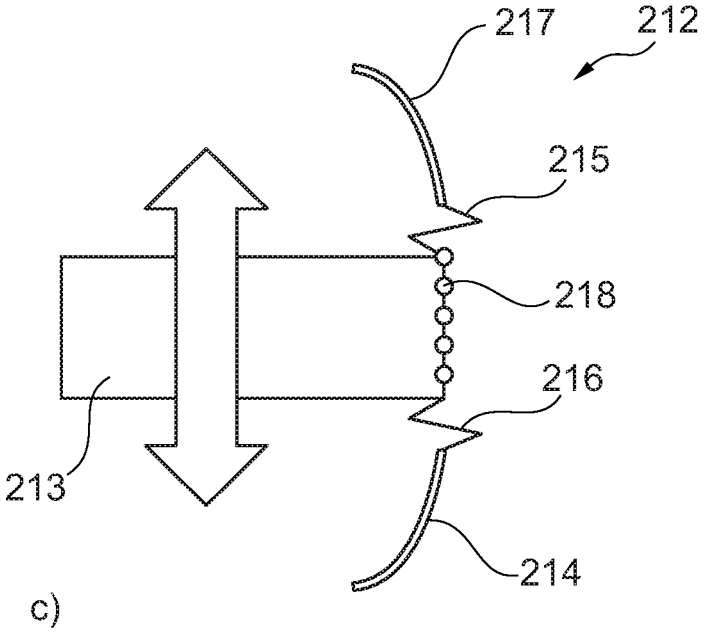
Figure 3:
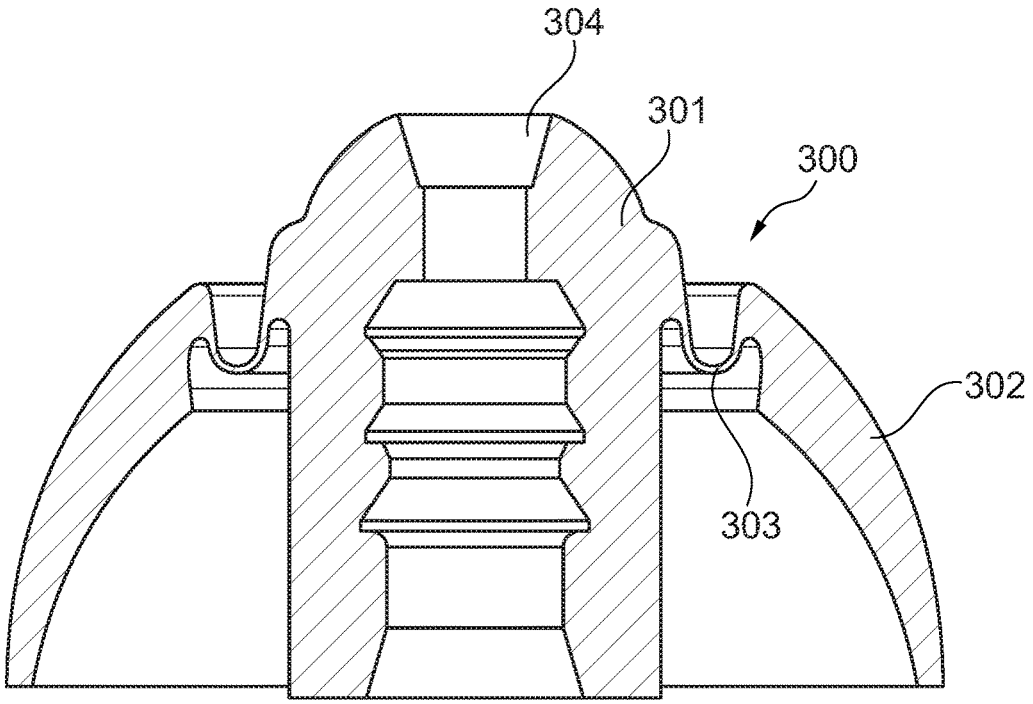
FIG. 3 shows cross-sectional views of two integrated vibration isolation arrangements.
Figure 3:
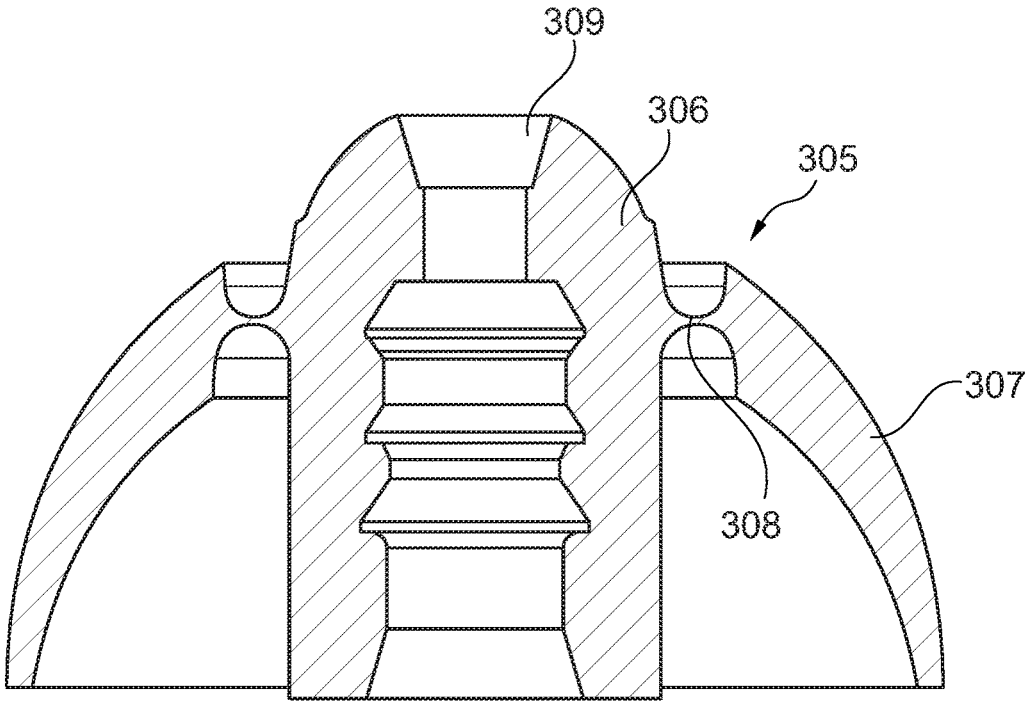

While the invention is susceptible to various modifications and alternative forms specific embodiments have been shown by way of examples in the drawings and will be described in details herein. It should be understood, however, that the invention is not intended to be limited to the particular forms disclosed. Rather, the invention is to cover all modifications, equivalents, and alternatives falling within the spirit and scope of the invention as defined by the appended claims.

DETAILED DESCRIPTION OF THE INVENTION

In its broadest aspect the present invention relates to a hearing device comprising a vibration preventing arrangement for reducing feedback between a receiver and a microphone of the hearing device. The vibration preventing arrangement is thus adapted to prevent that vibrations generated by the receiver of the hearing device reach the microphone of the same hearing device or a microphone associated therewith. The vibration preventing arrangement of the present invention allows for a higher stable gain between the microphone inlet and the receiver output.

The principle of the present invention is applicable to all types of hearing devices where a stable and high gain between a microphone inlet and a receiver output is desired. However, due the compact design of for example an MRIC the principle of the present invention is of particular relevance in connection with such designs.

FIG. 1 illustrates at least some of the vibration problems associated with prior art hearing devices 100, such as MRICs. The MRIC shown in FIG. 1 comprises a housing 101 within which housing a microphone 102 and a receiver 103 are arranged. A spout/nozzle 104 through which sound leaves the MRIC is secured to the housing 101. The MRIC 100 is adapted to be held in position in the ear canal by the dome-shaped element 105 with the spout/nozzle 104 pointing in the direction of the eardrum.

Upon activation of the receiver 103 the MRIC 100 may vibrate as illustrated by the arrow 108. The vibrations induced by the receiver 103 are transferred to the dome-shaped element 105 as indicated by the arrows 106, 107. It should be noted that the direction of vibration may be different from what is depicted in FIG. 1. The direction of vibration may for example depend on the type of receiver applied.

As the MRIC 100 is intended for being positioning in the ear canal of the user the vibrations 106, 107 of the dome-shaped element 105 may generate an undesirable feedback signal in the form of pressure variations to the microphone 102 of the MRIC 100—said undesirable feedback signal setting a limit to an achievable gain between the microphone 102 and the receiver 103. Thus, the undesirable feedback signal should be avoided or reduced to a minimum in order to obtain a stable as well as a high gain between the microphone 102 and the receiver 103 of the MRIC 100. The embodiments shown in FIGS. 2-7 provide various solutions to the above-mentioned feedback problems.

FIG. 2*a* shows a cross-sectional view of an MRIC 200 according to an embodiment of the present invention. As seen in FIG. 2*a* the housing 201 of the MRIC 200 is operatively connected to dome-shaped elements 202, 205 of the same dome via respective high compliant elements 204, 203. The high compliant elements 204, 203 prevent that in particular longitudinal vibrations generated within the MRIC housing 201 are transferred to the dome-shaped elements 202, 205. The high compliance of the elements 204, 203 may be provided by manufacturing these element 204, 203 in a soft and compliant material, such as rubber, silicone etc. Moreover, the high compliance of the elements 204, 203 may form an integral part of the respective dome-shaped elements 202, 205, or they may be implemented as discrete elements.

The high compliant elements 204, 203 are adapted for providing vibration isolation in the transverse direction of the MRIC housing 201 as illustrated by the linear arrow. It should be noted that vibration isolation may be provided in other directions than the longitudinal direction. In fact the implementation of the high compliant elements 204, 203 may be tailored to provide vibration isolation in a predetermined direction or directions.

Referring now to the MRIC 206 shown in FIG. 2*b* the MRIC housing 207 is suspending in two spring-shaped high compliant elements 210, 209 which are operatively connected to respective dome-shaped elements 208, 211. The two spring-shaped high compliant elements 210, 209 provide vibration isolation in both the transverse as well as the longitudinal directional as illustrated by the curved arrow. Again, the spring-shaped high compliance elements 210, 209 may be manufacturing in a soft and compliant material, such as rubber, silicone etc. Moreover, they may form an integral part of the respective dome-shaped elements 208, 211, or they may be implemented as discrete elements.

The MRIC 212 shown in FIG. 2*c* comprises an MRIC housing 213 suspending in two spring-shaped high compliant elements 216, 215 which are operatively connected to respective dome-shaped elements 214, 217 and the plurality of joint points 218 in the form of compliant rods. The two spring-shaped high compliant elements 216, 215 provide vibration isolation in the transverse directional as illustrated by the linear arrow. Similar to the embodiments shown in FIGS. 2*a* and 2*b* the spring-shaped high compliance elements 216, 215 may be manufacturing in a soft and compliant material, such as rubber, silicone etc. Moreover, they may form an integral part of the respective dome-shaped elements 214, 217, or they may be implemented as discrete elements.

FIGS. 3*a* and 3*b* depict two cross-sectional views 300, 305 of positioning arrangements adapted to position and hold hearing devices in the ear canal of a user. As seen in FIG. 3*a* the positioning arrangement 300 comprises a stem 301, a dome-shaped element 302 and a U-shaped high compliant element 303. The stem 301 is adapted for securing the positioning arrangement 300 to a spout/nozzle 304 of the hearing device. The high compliance of the element 303, which forms an integral part of the positioning arrangement 300, is provided by 1) reducing the thickness of the material in this area, and/or 2) profiling this area in a proper manner in order to allow relative movements, i.e. vibration isolation, of the stem 301 and the dome-shaped element 302 along the longitudinal direction of the stem 304. As the high compliant element 303 forms an integral part of the positioning arrangement all three parts, i.e. the stem 301, the dome-shaped element 302 and the high compliant element 303, are made of the same material, such as for example rubber, silicone etc., using a suitable injection mounding process. The stem 301 can be secured to the spout/nozzle 304 by various means, including gluing, clamping etc.

In FIG. 3*b* the positioning arrangement 305 also comprises a stem 306, a dome-shaped element 307 and a high compliant element 308. Also in this embodiment the stem 306 is adapted to be secured to a spout/nozzle 309 of the hearing device. Similar to the embodiment shown in FIG. 3*a* the high compliant element 308 forms an integral part of the positioning arrangement 305, and the high compliance is provided by a proper shaping and profiling, such as thinning, of the material in this area in order to allow longitudinal movements between the stem 306 and the dome-shaped element 307. As the high compliant element 308 forms an integral part of the positioning arrangement 305 all three parts, i.e. the stem 306, the dome-shaped element 307 and the high compliant element 308 are made of the same material, such as for example rubber, silicone etc. Similar to the previous embodiment the stem 306 can be secured to the spout/nozzle 309 by various means, including gluing, clamping etc.

Figure 4:
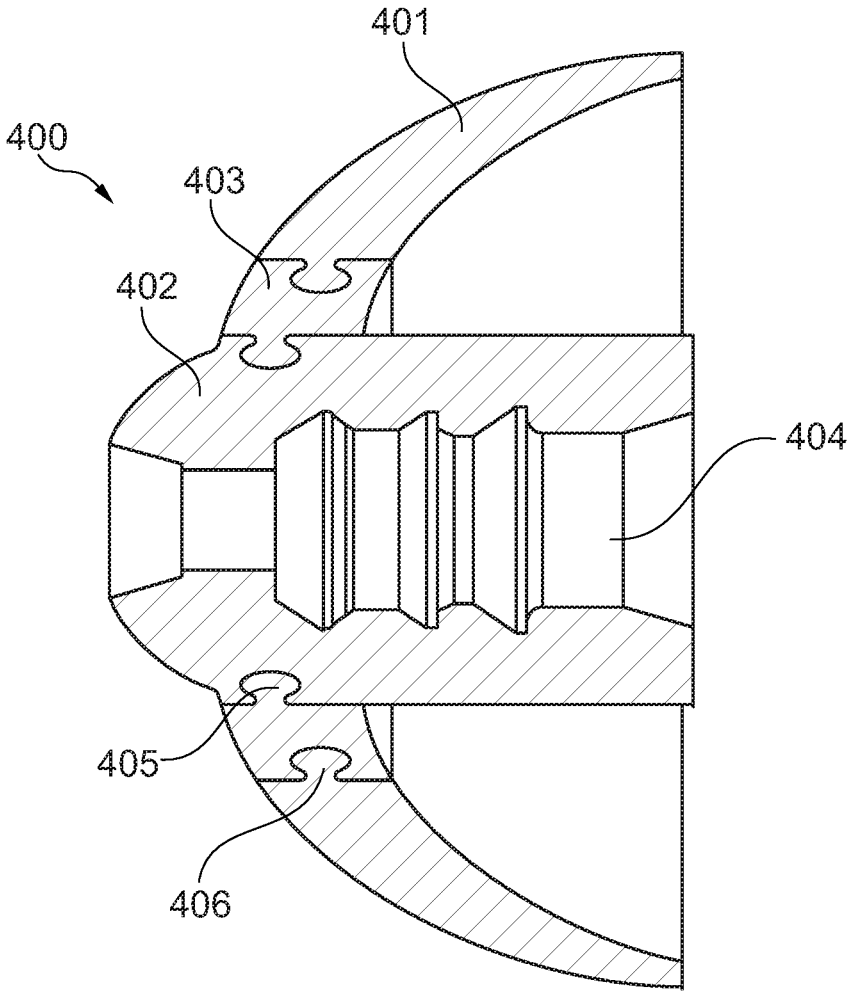
FIG. 4 shows a cross-sectional view of a discrete vibration isolation arrangement.

FIG. 4 shows a cross-sectional profile of another embodiment 400 of the present invention. In FIG. 4 the positioning arrangement 400 takes the form of an assembly comprising a stem 402, a dome-shaped element 401 and a discrete high compliant element 403. Also in this embodiment the stem 402 is adapted to be secured to a spout/nozzle 404 of the hearing device. In contrast to the embodiment shown in FIGS. 3*a-c* the high compliant element 403 forms a discrete and separate element being secured to the stem 402 and the dome-shaped element 401 by appropriate engaging members 405, 406. The discrete high compliant element 403 may for example be made of a material being softer and thereby more compliant compared to the material of the stem 402 and the dome-shaped element 401. Suitable materials for the discrete high compliant element 403 may involve rubber, silicone etc. Similar to the previous embodiment the stem 402 can be secured to the spout/nozzle 404 by various means, including gluing, clamping etc. The discrete high compliant element 403 allows relative movements between the stem 402 and the dome-shaped element 401 in at least the longitudinal direction of the stem 402.

Figure 5:
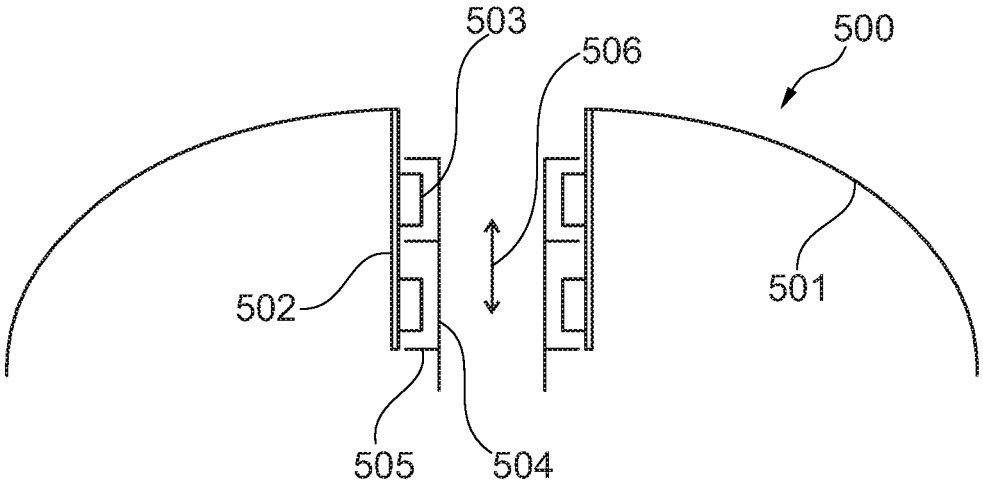
FIG. 5 shows a cross-sectional view of another embodiment of the present invention.

FIG. 5 shows a cross-sectional profile of yet another embodiment 500 of the present invention. As depicted in FIG. 5 a dome-shaped element 501 is secured to a stem 502 having a number of inwardly directed projections 503 integrated therewith and/or attached thereto. The number of projections may differ from the four projections shown in FIG. 5. As illustrated by the arrow 506 in FIG. 5 the dome-shaped element 501 as well as the stem 502 are displaceable relative to the spout/nozzle 504 which may be secured to a hearing device housing (not shown) or directly to the receiver (not shown). The fact that in particular the dome-shaped element 501 is displaceable relative to the spout/nozzle 504 ensures that vibrations generated by the receiver (not shown) are not transferred to the dome-shaped element 501 whereby undesired feedback signals generated by the vibrating dome-shaped element 501 is avoided. A number of mechanical stop members 505 limits the longitudinal movements of the projections 503, and thereby the stem 502, relative to the spout/nozzle 504. Thus, it is ensured that the relative movements between the spout/nozzle 504 and the stem 502 never come out of control. The dome-shaped element 501, the stem 502 and the projections 503 may form a single element being manufactured of the same material.

Figure 6:
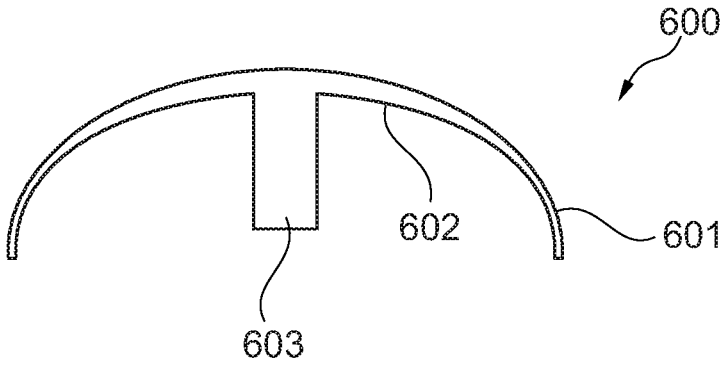
FIG. 6 shows cross-sections views of arrangements for making the dome stiffer.
Figure 6:
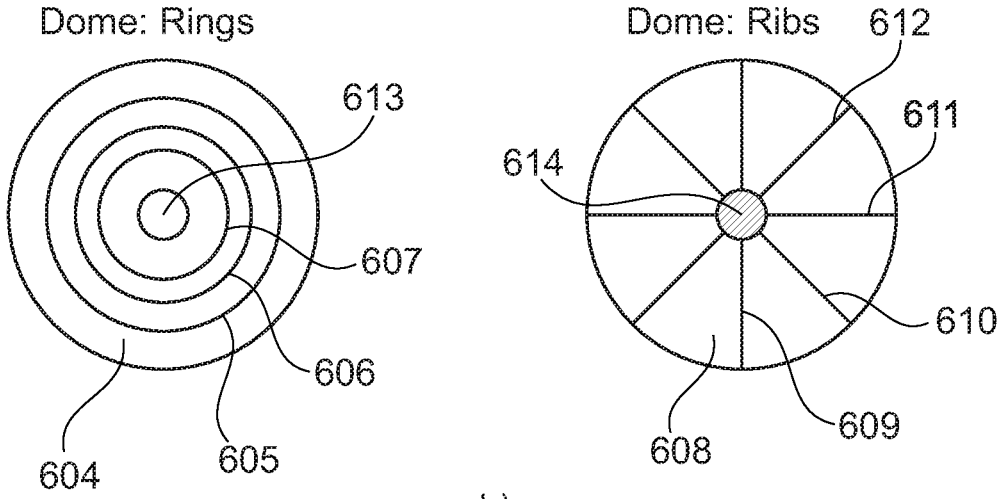
Figure 7:
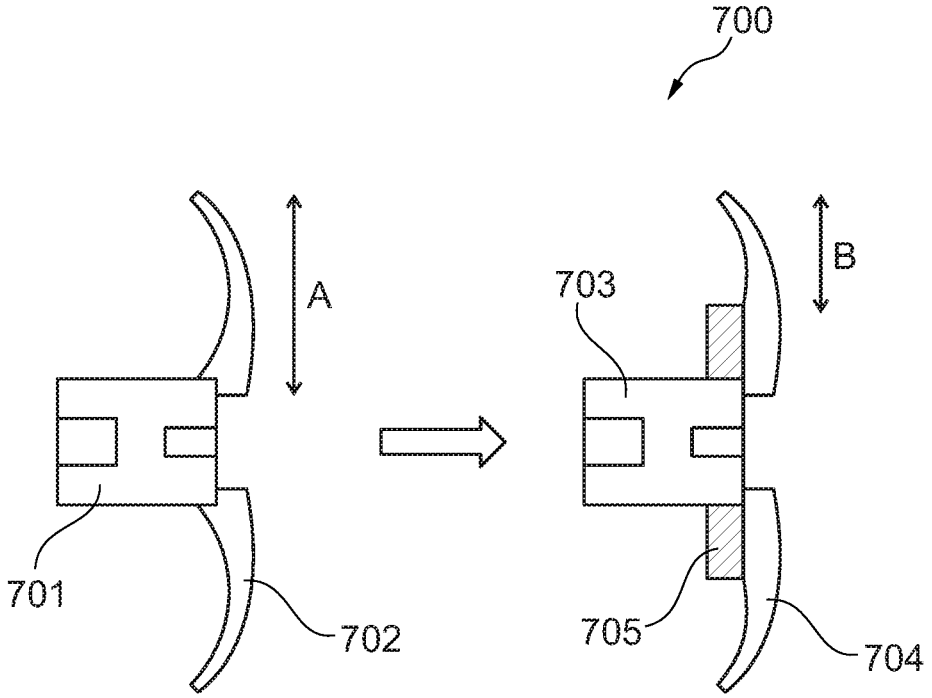
FIG. 7 shows a cross-sectional view of an arrangement for reducing the area of the dome.

With reference to FIGS. 6 and 7 further embodiments of the present invention will now be discussed. It is a common feature of the embodiments of FIGS. 6 and 7 that the mechanical structure of the dome-shaped element is altered via various implementations so that some portions of the dome-shaped element becomes stiffer than other portions. This is illustrated in the cross-sectional profile of FIG. 6*a* where an inner portion 602 of a dome-shaped element is thicker and thereby stiffer than the outer portion 601 of the same element. An overall system including an MRIC and dome-shaped element being stiffer at selected portions is less sensitive to a vibrating receiver spout/nozzle (not shown) due to a change of the amplitude/resonance frequency of the overall system. A stem 603 integrated with or secured to the inner portion 602 may be attached to the spout/nozzle by various means, including gluing, clamping etc.

Referring now to FIG. 6*b* two views into the concave side of dome-shaped elements are depicted. In the left figure a dome-shaped element 604 having an opening 613 through a stem is depicted. As seen in the left figure a series of concentric rings 605, 606, 607 are either integrated with or secured to the dome-shaped element. Each of the concentric rings 605, 606, 607 locally increases the thickness of the dome-shaped element whereby selected portions of the dome-shaped element may be made stiffer. It should be noted that the number of rings may differ from three. Also, the cross-sectional profile of the rings may be the same, or they may be different. Thus, by proper dimensioning and positioning the concentric rings the mechanical properties of the dome-shaped element may be tailored specific demands.

In the right figure in FIG. 6*b* a dome-shaped element 608 having an opening 614 through a stem is depicted. The dome-shaped element 608 comprises a series of radially oriented ribs 609-612 which are either integrated with or secured to the dome-shaped element. Each of the ribs 609-612 locally increases the thickness of the dome-shaped element whereby selected portions of the dome-shaped element may be made stiffer. The ribs 609-612 may, or may not, be evenly distributed, and the number of ribs may differ from four. Similar to the concentrically arranged rings the cross-sectional profile of the ribs may be the same, or they may be different. Thus, by proper dimensioning and positioning the ribs the mechanical properties of the dome-shaped element may be tailored specific demands.

It should be noted that the use of concentrically arranged rings and radially oriented ribs may be combined in order to tailor the mechanical and thereby structural properties of the dome-shaped element.

Turning now to FIG. 7 yet another embodiment of the present invention is depicted. The general idea behind the embodiment depicted in FIG. 7 (right side) is to reduce the area of the moveable portion of the dome-shaped element 702, 704. In the left figure of FIG. 7 the dome-shaped element 702 has an increasing thickness in the direction of the centre of the element, i.e. in the direction towards the housing 701 of the hearing device. Thus, the dome-shaped element 702 becomes stiffer when approaching the hearing device housing 701. This has been taken a step further in the right figure in FIG. 7 where a mechanically stiff rim 705 is secured to the hearing device housing 703. As seen in FIG. 7 (right figure) the mechanically stiff rim 705 supports the dome-shaped element 704 so that the moveable portion, and thereby the moveable area, of the dome-shaped element 702, 704 has been reduced from the radial length A (in the left figure) to the radial length B in the right figure. The appliance of the rim 705 effectively makes the inner portion of the dome-shaped element 704 completely stiff and thereby essentially insensitive to longitudinal vibrations caused by the receiver of the hearing device. In fact, the appliance of the rim 705 is equivalent to increasing the size of the hearing device housing 703 in the transverse direction. In conclusion, the appliance of the rim 705 is an alternative approach for making the dome-shaped element 704 insensitive to receiver vibrations in order to avoid undesired feedback signals to the microphone of the hearing device 700. An alternative approach for reducing the area of the dome-shaped element 704 is to make the outer dimensions of the dome-shaped element 704 smaller.

The invention claimed is:

1. A hearing device assembly adapted to be positioned in an ear canal of a user, the hearing device assembly comprising, a hearing device comprising a receiver unit, a positioning member adapted to position and hold the hearing device assembly in the ear canal of the user, and a vibration preventing arrangement adapted to prevent vibrations of at least part of the positioning member by vibration isolating at least part of the positioning member from the receiver unit, wherein the vibration preventing arrangement and the positioning member form a single and integral member of the same material, or wherein the vibration preventing arrangement forms a discrete member adapted to be secured to the positioning member, wherein the vibration preventing arrangement forms a suspension member between the receiver unit and at least part of the positioning member, the suspension member being more compliant than the positioning member, the suspension member being located external to the hearing device to operatively connect the positioning member to the hearing device.

2. A hearing device according to claim 1, further comprising a microphone unit being either integrated with the hearing device or being associated therewith.

3. A hearing device according to claim 1, further comprising a stem forming an integral part of the single integral member, the stem being adapted to be secured to a spout/nozzle of the hearing device or the receiver unit.

4. A hearing device according to claim 1, further comprising a stem adapted to be secured to a spout/nozzle of the hearing device or the receiver unit, and wherein the discrete member is secured to the positioning member and the stem via respective engaging members and recesses.

5. A hearing device according to claim 4, wherein the positioning member is made of a first material, the stem is made of a second material, and the discrete member is made of a third material.

6. A hearing device according to claim 1, wherein at least part of the positioning member has thickness variations in order to make selected portions of the positioning member stiffer.

7. A hearing device according to claim 6, wherein the vibration preventing arrangement comprises a number of essentially concentrically arranged rings secured to or integrated with the positioning member, a number of radially arranged ribs secured to or integrated with the positioning member and/or a number of spirals secured to or integrated with the positioning member.

8. A hearing device according to claim 6, further comprising a stem adapted to be secured to a spout/nozzle of the hearing device or the receiver unit of the hearing device, wherein the positioning member, the vibration preventing arrangement and the stem forms a single and integral member of the same material.

9. A hearing device according to claim 6, wherein the thickness variations comprise angular and/or radial thickness variations.

10. A hearing device according to claim 1, wherein at least part of the positioning member takes the form of a dome umbrella.

11. A hearing device according to claim 1, wherein the positioning member comprises a tuned venting opening.

12. A hearing device according to claim 1, further comprising one or more additional transducers, integrated with and/or associated with the hearing device.

13. A hearing device according to claim 1, further comprising an arrangement for reducing a moveable area of the positioning member.

14. A hearing device according to claim 1, wherein the suspension member provides vibration isolation in at least a traverse direction to a spout/nozzle of the hearing device.

15. A hearing device according to claim 14, wherein the suspension member provides vibration isolation in at least the transverse direction to the spout/nozzle and a longitudinal direction with the spout/nozzle.

16. A hearing device adapted to be positioned in an ear canal of a user, the hearing device comprising, a receiver unit, and a positioning member adapted to position and hold the hearing device in the ear canal of the user, wherein the receiver unit is moveably arranged relative to the positioning member so that receiver unit induced vibrations are essentially not transferred to the positioning member, the hearing device further comprising a stem secured to the positioning member, the stem including a number of inwardly directed projections integrated therewith and/or attached thereto, the stem being moveably arranged relative to a spout/nozzle of the receiver unit so that the positioning member and the stem are displaceable along longitudinal movements relative to the spout/nozzle, the inwardly directed projections engaging a number of mechanical stop members of the spout/nozzle of the receiver unit in order to limit movements of the stem relative to the receiver unit responsive to the receiver unit induced vibrations.

17. A hearing device according to claim 16, further comprising a microphone unit being either integrated with the hearing device or being associated therewith.

18. A hearing device according to claim 16, wherein at least part of the positioning member takes the form of a dome umbrella.

19. A hearing device according to claim 16, wherein the stem is slidably arranged relative to the spout/nozzle of the receiver unit.

* * * * *